US006316172B1

(12) United States Patent
Hashimoto

(10) Patent No.: US 6,316,172 B1
(45) **Date of Patent: *Nov. 13, 2001**

(54) HEAT-DEVELOPABLE PHOTOGRAPHIC LIGHT-SENSITIVE MATERIAL AND HEAT-DEVELOPMENT METHOD THEREOF

(75) Inventor: Kiyokazu Hashimoto, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/401,330

(22) Filed: Sep. 23, 1999

(30) Foreign Application Priority Data

Sep. 29, 1998 (JP) ..... 10-276231

(51) Int. Cl.[7] ..... G03C 1/76; G03C 8/40; G03C 1/795

(52) U.S. Cl. ..... 430/350; 430/531; 430/533; 428/220; 428/480

(58) Field of Search ..... 430/531, 619, 430/350, 533, 496, 349; 428/480, 220

(56) References Cited

U.S. PATENT DOCUMENTS 4,954,430 * 9/1990 Ishigaki et al. ..... 430/534
6,027,871 * 2/2000 Katoh ..... 430/619
6,060,226 * 5/2000 Hashimoto ..... 430/496

FOREIGN PATENT DOCUMENTS

0810468 * 3/1997 (EP) .
8-211547 A 8/1996 (JP) .

* cited by examiner

*Primary Examiner*—Thorl Chea
(74) *Attorney, Agent, or Firm*—Sughrue, Mion, Zinn, Macpeak & Seas, PLLC

(57) ABSTRACT

There is disclosed a heat-developable photographic light-sensitive material, wherein the degree of warp at the edge portion of each of four sides of the light-sensitive material after heat development is in the range of from 0 mm/50 cm to 4 mm/50 cm. Further, there is disclosed a heat-development method thereof. The heat-developable photographic light-sensitive material can exhibits such an excellent effect that the planar property after a heat development is good, and consequently the problem of printing blur does not occur, not only in ordinary use but also even in use as a light-sensitive material for printing. Further, the heat-development method can exerts an excellent effect as a method for maintaining excellent planar property and consequently restraining the occurrence of the printing blur problem, when the heat-developable photographic light-sensitive material is subjected to heat development.

15 Claims, 2 Drawing Sheets

HEAT-DEVELOPABLE PHOTOGRAPHIC LIGHT-SENSITIVE MATERIAL AND HEAT-DEVELOPMENT METHOD THEREOF

FIELD OF THE INVENTION

The present invention relates to a heat-developable photographic light-sensitive. material, and to a heat-development method thereof.

BACKGROUND OF THE INVENTION

Hitherto, for a silver halide photographic light-sensitive material, a wet development method has been applied using a developing solution after photographing. However, the method has the following inconveniences, and improvement has been desired.

[1] Because development, bleaching, fixing, and drying are carried out, a long time is required for the development processing.

[2] Because plural tanks containing a developing solution are required, a processor cannot be made small in size and light in weight.

[3] Inconveniences, such as the replenishment of a developing solution, the disposal of processing liquids, washing of developing tanks, etc., are required.

In order to improve the above, photographic light-sensitive materials that are processed using a development method by heating (referred to as "heat development" in some cases hereinafter) to a temperature of from 80 to 150° C. are proposed, as described in, for example, the specification of U.S. Pat. No. 3,152,904, the specification of U.S. Pat. No. 3,457,075, JP-B-43-4921 ("JP-B" means an examined Japanese patent publication), and JP-B-43-4924. One example is a method of previously incorporating a precursor for a developing agent in a light-sensitive layer, decomposing the precursor by heating, to form a developing agent, and subjecting to development. In such a heat-development system, the development processing may be carried out by only applying heat, whereby the processing can be carried out in a short time and a processor can be small in size. Furthermore, the system has such characteristics that there are no inconveniences with the replenishment and the disposal of a developing solution.

However, when the light-sensitive material of this system was used as a printing light-sensitive material, distortion of an image and color discrepancy for 4 color plate images (blue, green, red, and black) were caused by the dimensional changes that occurred during heat development. To solve the problem, a method of heat treatment of a support under a low tension is proposed in JP-A-8-211547 ("JP-A" means unexamined published Japanese patent application).

However, in this method, when a heat-developable light-sensitive material after heat development is used for exposure being contacted on a printing plate (e.g., presensitized printing plate (hereinbelow referred to as PS printing plate)), it results in a so-called "printing blur (unsharp)" on the printing plate. Therefore, improvement on this problem has been demanded. The blur occurs due to unfocused photographing at a portion where the planar property of the heat-developed light-sensitive material is deteriorated, so that the plane thereof locally rises up. In particular, this problem is apt to occur at the outer peripheral portion, and it occurs remarkably in a large-sized plate for use in a newspaper, having a side of 45 cm or more.

SUMMARY OF THE INVENTION

An object of the present invention is to provide a heat-developable photographic light-sensitive material having such a good planar property after heat development that no printing blur problem occurs.

Another object of the present inventions is to provide a heat-development method thereof.

Other and further objects, features, and advantages of the invention will appear more fully from the following description, taken in connection with the accompanying drawings.

DETAILED DESCRIPTION OF THE INVENTION

Figure 1:
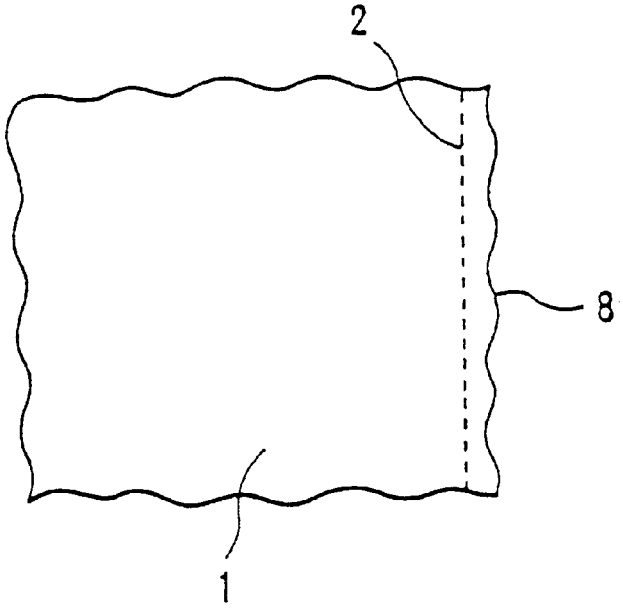
FIG. 1 is a diagrammatic view showing warps at the four sides and a slit position for measuring a degree of the warp in the present invention.

Namely, according to the present invention there are provided the following inventions:

(1) A heat-developable photographic light-sensitive material, wherein the degree of warp at the edge portion of each of four sides of the light-sensitive material after heat development is in the range of from 0 mm/50 cm to 4 mm/50 cm;

(2) The heat-developable photographic light-sensitive material as described in the item (1), wherein the degree of undulation (waviness) at the edge portion of each of four sides of the light-sensitive material after heat development is in the range of from 0 $mm^2$/50 cm to 500 $mm^2$/50 cm;

(3) The heat-developable photographic light-sensitive material as described in the item (1) or (2), wherein a thermal dimensional change at 120° C. for 30 seconds is in the range of from −0.05 to +0.05% in both the longitudinal direction (machine direction) and the transverse direction (width-wise direction);

(4) The heat-developable photographic light-sensitive material as described in the item (1), (2), or (3), wherein a water-absorbing dimensional changing rate after heat development at 120° C. for 30 seconds is in the range of from 0%/2 hours to 0.025%/2 hours in both the longitudinal direction and the transverse direction;

(5) The heat-developable photographic light-sensitive material as described in any one of the items (1) to (4), comprising a support, which is a polyethylene terephthalate-series film that has been subjected to heat treatment at a temperature between 140° C. and 200° C., at a tension of 0 kg/m to 5 kg/m, for a time period in the range of from 20 seconds to 5 minutes;

(6) The heat-developable photographic light-sensitive material as described in any one of the items (1) to (5), which has a support whose both surfaces each are applied to provide a layer of a polyvinylidene chloride-series resin, in a thickness of 0.5 $\mu$m to 10 $\mu$m;

(7) A method for subjecting, to heat-development, a heat-developable photographic light-sensitive material, which comprises the step of subjecting, to heat-development, the heat-developable photographic light-sensitive material described in any one of the items (3) to (6), wherein the subjecting to heat-development step is carried out under a distribution of conveyance tension in the range of 0 to 0.5;

(8) A method for subjecting, to heat-development, a heat-developable photographic light-sensitive material, which comprises the steps of heating the heat-developable photographic light-sensitive material described in any one of the items (3) to (6), at a raising rate of 1° C./second to 15° C./second, and subjecting the light-sensitive material to heat development;

(9) A method for subjecting, to heat-development, a heat-developable photographic light-sensitive material, which comprises the steps of subjecting, to heat-development, the heat-developable photographic light-sensitive material described in any one of the items (3) to (6), and cooling the light-sensitive material at a cooling rate of −8° C./second to −1° C./second;

(10) The method for subjecting, to heat-development, a heat-developable photographic light-sensitive material as described in the items (7), (8), or (9), wherein a heat-development temperature is in the range of 80° C. to 140° C., a temperature distribution along the transverse direction is in the range of from 0° C. to 10° C., and a heat-development time is in the range of from 10 seconds to 120 seconds; and

(11) The heat-developable photographic light-sensitive material as described in the items (1) or (2), wherein the heat-developable photographic light-sensitive material described in any one of the items (3) to (6), is subjected to heat-development by the method described in any one of the items (7) to (10).

One side of the outer periphery of a heat-developable photographic light-sensitive material (hereinafter referred to as "a heat-developable light-sensitive material" according to the occasion), after heat development, is slit in a width of 1 cm. When the other side opposite to the slit side is placed along a straight ruler, a gap between the ruler and the slit is formed if one end of the side of the slit is put on the ruler. The interval of the gap is standardized by the length of the slit side, and the obtained standardized value is defined as the degree of warp. If the degree of warp is large, the outer peripheral portion of the light-sensitive material becomes like a circular arc, so that bending (deflecting) occurs because the length of the periphery becomes longer. The place of the bending causes a printing blur.

The degree of warp at the edge portion of each of four sides of the heat-developable light-sensitive material according to the present invention is preferably from 0 mm/50 cm to 4 mm/50 cm, more preferably from 0 mm/50 cm to 3 mm/50 cm, and further more preferably from 0 mm/50 cm to 2 mm/50 cm.

Such a degree of warp allows the degree of undulation at the edge portion of each of four sides thereof after heat development, to regulate in a range of preferably from 0 $mm^2$/50 cm to 500 $mm^2$/50 cm, more preferably from 0 mm /50 cm to 400 mm/50 cm, and further more preferably from 0 $mm^2$/50 cm to 300 $mm^2$/50 cm. The degree of undulation means an observed value of a wavy portion lifted from the base line, which portion occurs when a heat-developable light-sensitive material after heat development has been placed on a flat stand as a base line. Further, the degree of undulation is a value obtained by multiplying the height (mm) and the width (mm) of each of the undulation portions, and adding up the figures for each of the sides, and then standardizing the total with a length of each of the sides.

By controlling the degree of warp and the degree of undulation to the above-described ranges, a contact exposure to a PS plate satisfactorily can be practiced without causing any blur.

In order to attain such a heat-developable light-sensitive material after heat development, there are two improvements, i.e., ① the improvement of a heat-developable light-sensitive material, and ② the improvement of a heat-development method. A certain effect can be obtained by only the ① or the ②. However, it is most preferred that they are practiced in combination. These are explained in detail below.

① Improvement of Heat-developable Light-sensitive Material

A point of the improvement of the heat-developable light-sensitive material is to minimize a dimensional change during a heat development. Namely, the dimensional change when heated at 120° C. for 30 seconds (referred to as "thermal dimensional change at 120° C. for 30 seconds" in this specification and the claims), is preferably from −0.05% to +0.05%, more preferably from −0.03% to +0.04%, and further more preferably from −0.02% to +0.04%, in both the longitudinal direction (hereinafter referred to as MD) and the transverse direction (width-wise direction) (hereinafter referred to as TD).

The heat-developable light-sensitive material is conveyed with rolls mounted in a heat processor (heat-development apparatus). Because a nip force in the rolls is not uniform over the whole width, the heat-developable light-sensitive material is partially stretched. Such an ununiformity of the nip force of the rolls is especially outstanding at the edge portion of the four sides of the heat-developable light-sensitive material. Consequently, the edge portion is stretched and easily deformed like an undulation.

In order to manufacture a heat-developable light-sensitive material having minimized thermal dimensional change, it is important to minimize a thermal dimensional change of the support thereof. To meet this requirement, the support is subjected to heat treatment while conveying at a low tension, when the heat-developable light-sensitive material is manufactured.

A temperature of a heat treatment of the support is preferably the range of from 140° C. to 200° C., more preferably from 145° C. to 180° C., and further more preferably from 150° C. to 165° C. A conveyance tension is preferably in the range of from 0 kg/m to 5 kg/m, more preferably 0 kg/m to 4 kg/m, and further more preferably from 0.5 kg/m to 3 kg/m. A period of time for the heat treatment is preferably in the range of from 20 seconds to 5 minutes, more preferably from 30 seconds to 3 minutes, and further more preferably from 45 seconds to 2 minutes. Such a heat treatment may be practiced at any stage ranging from after a film formation of the support to before coating the light-sensitive layer. However, the stage ranging from after coating the back layer to before coating the light-sensitive layer is preferred.

Example of the support to be used include polyesters such as polyethyleneterephthalate (PET), and polyethylenenaphthalate (PEN); vinyl-series polymers such as a polycarbonate (PC), a polyacrylate, and a syndiotactic polystyrene (SPS), and a polyethylene terephthalate-series film in which a cellulose polymer such as cellulose triacetate (TAC) is subjected to a thermoplastic resin heat treatment. Of these supports, PET, PEN, PC, SPS, and a composite (a laminating or a blending) thereof are preferred. PET is especially preferred. The thickness of these supports is preferably in the range of from 80 $\mu$m to 200 $\mu$m, more preferably from 95 $\mu$m to 180 $\mu$m, and further more preferably from 100 $\mu$m to 140 $\mu$m.

Further, the water-absorbing dimensional changing rate after heat development at 120° C. for 30 seconds is preferably controlled in the range of from 0%/2 hours to 0.025%/2 hours, more preferably from 0%/2 hours to 0.020%/2 hours, and further more preferably from 0%/2 hours to 0.015%/2 hours.

A moisture in a light-sensitive layer and a support is instantly evaporated by a heat development. However, these materials, when stood at a room temperature, absorb water again. As a result, a heat-developable light-sensitive material volume-expands, so that a dimension becomes longer in the lapse of time. The term "water-absorbing dimensional changing rate after heat development" means the above-mentioned changing speed. Namely, the water-absorbing speed is determined by a difference between a dimension just after a heat development (after 3 minutes) and a dimension after a fixed time (2 hours). If a value of the water-absorbing speed is excessively high, it means that a drastic water absorption occurs, and therefore undulation easily occurs even on a heat-developable light-sensitive material, as if a paper absorbs water, so that the undulation occurs thereon.

A heat-developable light-sensitive material having such a water-absorbing dimensional changing rate can be attained by each coating a polyvinylidene chloride-series resin layer on both surfaces of the support with the thickness of preferably from 0.5 $\mu$m to 10 $\mu$m, more preferably from 1 $\mu$m to 5 $\mu$m, and further more preferably from 1.5 $\mu$m to 3 $\mu$m. Further, the polyvinylidene chloride to be used is preferably a copolymer, and the amount of a vinylidene chloride residue to be contained is preferably in the range of from 70 to 99.9 wt. %, more preferably from 85 to 99 wt. %, and further more preferably from 90 to 99 wt. %. Examples of a copolymer component other than vinylidene chloride include methacrylic acid and esters thereof, methyl methacrylic acid and esters thereof, and acrylonitrile. The weight-average molecular weight of these copolymers is preferably in the range of from 5,000 to 100,000, more preferably from 8,000 to 80,000, and further more preferably from 10,000 to 45,000. A coating of the polyvinylidene chloride-series resin onto a support may be practiced by a method for coating a solution having dissolved the above-said resin in an organic solvent, or alternatively by a method for coating a latex dispersed in water. However, the latter is more preferred.

② Improvement of Heat-development Method

Further, it is more preferred that an improvement of the heat-development method be carried out in addition to the improvement of the heat-developable light-sensitive material. A main point in this case is uniform setting of the conveyance tension (making the distribution of conveyance tension narrow) during conveyance within the heat processor. That is, the conveyance tension at transverse ends and the conveyance tension at the center portion of the heat-developable light-sensitive material are made uniform. The distribution of the conveyance tension can be measured by a method described as follows.

1) A light-sensitive material is cut to (a width of the heat processor)×(a length of 50 cm). This cut material is further equally divided into three segments in the transverse direction.

2) The divided segments are simultaneously inserted into the heat processor to perform heat-development processing.

3) The time required for the light-sensitive material to be unloaded from the heat processor is measured (conveying time). When there is a certain distribution in the conveyance tension, the conveying time for the light-sensitive material conveyed on the portion having a high conveyance tension becomes short, and the conveying time on the portion having a low conveyance tension becomes long.

Accordingly, the ratio of the conveying time {(the longest time—the shortest time)/the shortest time} is equal to the distribution of the ratio of the conveyance tension (referred to as "the distribution of the conveyance tension" in this specification and the claims), and a preferable distribution of the conveyance tension is in the range of 0 to 0.5, more preferably 0 to 0.2, and further more preferably 0 to 0.1.

Hereinbelow, a conveyance roll consists of two or more rolls, and the conveyance roll conveys a light-sensitive material by passing it between these rolls.

It has become apparent, as a result of analysis by the inventions, that the distribution of the conveyance tension occurs through the following mechanism.

1) Linear expansion of the conveyance roll occurs when its temperature is raised up to a heat-development temperature. As both ends of the conveyance roll are fixed, extension of the roll is absorbed by deflection of the roll.

2) If the contacting surface of roll is deflected in a concave lens-like shape (which means that the central portion of the roll is lifted), the conveyance tension of the light-sensitive material at its central portion is decreased. On the other hand, if the contacting surface of roll is deflected in a convex lens-like shape (which means that both ends of the roll are lifted), the conveyance tension of the light-sensitive material at its ends is decreased.

Accordingly, the point of the present invention is that the conveyance tension is made uniform, in accordance with the following method.

a) The conveyance roll is provided with an extension-absorbing portion at both ends.

A space is provided in a bearing portion of the roll, to enable the roll to move transversely. The preferable amount of space is in the range of 0.1 to 1 mm, more preferably 0.2 to 0.9 mm, and further more preferably 0.3 to 0.8 mm.

b) A deformed roll is applied to offset the above deformation of a roll.

When the surface of roll is deformed to a concave lens-like shape, a roll having a diameter larger at the central portion than at both ends (a crown roll) is used. The preferable amount of convex degree of the roll (the increasing rate of the diameter at the central portion of the roll, compared with the diameter at both ends) is in the range of 1 to 10%, more preferably 2 to 9%, and further more preferably 3 to 8%.

When the surface of roll is deformed to a convex lens-like, a roll having a diameter larger at both ends than at the central portion (an inverted crown roll) is used. The preferable amount of concave degree of the roll (the increasing rate of the diameter at both ends of the roll, compared with the diameter at the central portion thereof) is in the range of 1 to 10%, more preferably 2 to 9%, and further more preferably 3 to 8%.

Since such a distribution of the conveyance tension is likely to occur when the transverse width is large, as is apparent from the aforesaid mechanism, the present invention is usually effective at a transverse width of 30 cm or more, more effective at a transverse width of 45 cm or more, and further more effective at a transverse width of 55 cm or more.

Furthermore, it is preferable to control the raising rate of temperature and the cooling rate at the inlet and the outlet of the heat processor. Namely, a sudden thermal expansion of the heat-developable light-sensitive material due to a sudden elevation of a temperature, and a sudden shrinkage of the heat-developable light-sensitive material due to a sudden lowering of the temperature are apt to cause warps and undulations at the edge portion of four sides thereof. The raising rate at the inlet is preferably in the range of from 1° C./second to 15° C./second, more preferably from 2° C./second to 10° C./second, and further more preferably from 2° C./second to 6° C./second. Establishment of such a raising rate can be accomplished by setting heaters in lots at the inlet of a heat processor, and elevating a temperature successively or stepwise.

Thereafter, a heat development is carried out. The heat-development temperature is preferably in the range of 80° C. to 140° C., more preferably from 90° C. to 130° C., and further more preferably from 100° C. to 125° C. At this time, the degree of warp and the degree of undulation can be made smaller by especially controlling a temperature distribution along the transverse direction preferably in the range of from 0° C. to 10° C., more preferably from 0° C. to 5° C., and further more preferably from 0° C. to 3° C. At that time, because the temperature at the both ends concerning the transverse direction of a heat processor tends to become lower than that of the central portion, it is preferred to set up a fixed temperature at the end portion concerning the transverse direction of the heat processor (preferably from 1 to 20 cm, more preferably from 3 to 15 cm, and further more preferably from 5 to 10 cm) preferably in the range of from 1° C. to 20° C., more preferably from 2° C. to 15° C., and further more preferably from 5° C. to 15° C. higher than that of the central portion. The heat-development time is preferably in the range of from 10 seconds to 120 seconds, more preferably from 14 seconds to 60 seconds, and further more preferably from 18 seconds to 40 seconds. Such a heat development may be carried out using radiant heat emitted from a panel heater, or alternatively it may be practiced by directly contacting a light-sensitive material with a heater.

After the heat development, a lowering of temperature at the outlet of the heat processor can be carried out at the cooling rate of preferably from −8° C./second to −1° C./second, more preferably from −5° C./second to −1.5° C./second, and further more preferably from −3° C./second to −1.5° C./second. Such a lowering of temperature can be also practiced by covering the outlet and outer portions therefrom with a heat-insulating material, or by positively heating by means of a heater.

A method for preparing a light-sensitive layer and a back layer of the heat-developable light-sensitive material of the present invention is described below.

The heat-developable light-sensitive material of the present invention has an image-forming layer (light-sensitive layer) containing an organic silver salt, a reducing agent, and a light-sensitive silver halide, on a support. Further, at least one layer of a protective layer is applied onto the image-forming layer. On the surface of the support opposite to the light-sensitive layer side, is applied a back layer that gives an antistatic property, a sliding property, an antihalation property, a matting property, a scratch-resistance, and the like. An undercoating layer may be applied between a light-sensitive layer and a support, if necessary.

The light-sensitive layer contains a dispersion of a silver halide, a chemical sensitizer, an organic silver salt, a reducing agent, an ultra high contrasting agent, a sensitizing dye, an antifogging agent, a plasticizer, and the like in a binder.

Preferably used binders are acrylic resins, vinyl acetate resins, polyester resins, polyurethane resins, rubber-series resins, vinyl chloride resins, vinylidene chloride resins, and polyolefin resins. More specific examples of the binder include methylmethacrylate/ethylmethacrylate/methacrylic acid copolymer, methyl methacrylate/2-ethylhexyl acrylate/hydroxy ethylmethacrylate/styrene/acrylic acid copolymer, styrene/butadiene/acrylic acid copolymer, styrene/butadiene/divinyl benzene/methacrylic acid copolymer, methyl methacrylate/vinyl chloride/acrylic acid copolymer, and vinylidene chloride/ethyl acrylate/acrylonitrile/methacrylic acid copolymer. Further preferably, styrene/butadiene-series polymer latex (LACSTAR 3307B, Nipol Lx430, 435, all are trade names) is preferably used. The weight average molecular weight of these binders is preferably in the range of from about 5,000 to about 1,000,000, and more preferably from about 10,000 to about 100,000. Further, to the binder, may be added a hydrophilic polymer such as a polyvinyl alcohol, a methyl cellulose, a hydroxypropyl cellulose, a carboxymethyl cellulose, and a hydroxypropylmethyl cellulose in an amount of 20 wt. % or less, based on the total binder.

The coating amount of the binder is preferably in the range of from 0.2 to 30 g/m$^2$, and more preferably from 1.0 to 15 g/m$^2$.

The silver halide may be any one of silver chloride, silver chlorobromide, and silver iodochlorobromide. The silver halide should preferably have a smaller grain size for the purpose of minimizing white turbidity after image formation. Specifically, the grain size is preferably up to 0.20 $\mu$m, more preferably from 0.01 $\mu$m to 0.15 $\mu$m, and further more preferably from 0.02 $\mu$m to 0.12 $\mu$m. The shape of silver halide grains may be cubic, octahedral, tabular, spherical, rod-like and potato-like, with cubic and tabular grains being particularly preferred in the practice of the present invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the plane indices (Miller indices) of an outer surface of light-sensitive silver halide grains. Preferably silver halide grains have a high proportion of {100} plane featuring high spectral sensitization efficiency upon absorption of a spectral sensitizing dye. The proportion of {100} plane is preferably at least 50%, more preferably at least 65%, and further more preferably at least 80%. A method for forming these silver halides is well known in the field of this technology. For example, methods described in Research Disclosure (June 1978) No. 17029, and U.S. Pat. No. 3,700,458 can be used.

Preferably the silver halide grains contain a metal or a complex of a metal selected from the VII group or the VIII group (the 7th group to the 10th group) of the periodic table, with rhodium, rhenium, ruthenium, osmium, and iridium being more preferred. These are described in, for example, JP-A-7-225449, JP-A-63-2042, JP-A-1-285941, JP-A-2-20852, and JP-A-2-20855. The amount of these compounds to be added is preferably in the range of from $1\times10^{-9}$ mol to $1\times10^{-5}$ mol, and especially preferably from $1\times10^{-8}$ mol to $1\times10^{-6}$ mol, per mol of silver halide.

The silver halide grains may contain a metal atom such as cobalt, iron, nickel, chromium, palladium, platinum, gold, thallium, copper, lead, and the like. With respect to cobalt, iron, chromium and ruthenium compounds, a hexacyano metal complex can be preferably used. The addition amount of these compounds is preferably in the range of from $1\times10^{-9}$ to $1\times10^{-4}$ mol, per mol of silver halide. Further, in order to incorporate the above-described metals into a silver halide grain, these metals can be added at the time of a grain formation as a metal salt in the form of a single salt, a double salt, or a complex salt.

The silver halide emulsion should preferably be chemically sensitized. For example, sulfur, selenium, tellurium, and noble metal sensitization methods can be used. In the sulfur sensitization, a sulfur compound in gelatin, a salt of thiosulfuric acid, thioureas, thiazoles, rhodanines, and the like can be used. The addition amount thereof is in the range of from $10^{-7}$ to $10^{-2}$ mol, per mol of silver halide. Useful as a selenium sensitizing agent, are those compounds described in, for example, JP-B-44-15748, JP-B-43-13489, JP-A-4-25832, JP-A-4-109240, and JP-A-4-324855. Preferred as a tellurium sensitizing agent, are those compounds represented by general formula (II), (III), or (IV) of JP-A-5-313284. The amount of selenium and tellurium sensitizing agent which can be used is in the range of from $10^{-8}$ to $10^{-2}$, per mol of silver halide. Examples of noble metal sensitizing agents include gold, platinum, palladium, and iridium, with a gold sensitization being especially preferred. The amount of a noble metal sensitizing agent to be used, is in the range of $10^{-7}$ to $10^{-2}$ mol, per mol of silver halide.

A reduction sensitization can be used in the present invention. Specific examples of the compounds used in the reduction sensitization method include ascorbic acid, thiourea dioxide, stannous chloride, aminoiminomethane sulfinic acid, hydrazine derivatives, boran compounds, silane compounds, and polyamine compounds.

The organic silver salt is any organic substance that contains a source capable of reducing a silver ion, with a silver salt of a long chain (10 to 30, preferably 15 to 28 carbon atoms) fatty carboxylic acid being especially preferred. Also useful are a silver salt of the compound having a mercapto group, or a thion group and derivatives thereof. No particular limit is imposed on the shape of an organic silver salt. Needle-like crystals having the minor axis and the line of apsides are preferred. Preferably the minor axis. is in the range of from 0.01 $\mu$m to 0.20 $\mu$m, and the line of apsides is in the range of 0.10 $\mu$m to 5.0 $\mu$m. The organic silver salt is used as a dispersion of solid fine grains using a dispersing agent for the purpose of obtaining fine grains free of aggregation.

In order to prepare a solid fine grain dispersion of an organic silver salt, the organic silver salt can be dispersed in the presence of a dispersing agent by a known means for making fine grains (e.g. ball mill, sand mill, jet mill, high pressure homogenizer). As the dispersing agent, the use can be made by properly selecting from polyacrylic acid, an acrylic acid copolymer, a maleic acid copolymer, a maleic acid monoester copolymer, an acryloylmethylpropanesulfonic acid copolymer, a carbodxymethyl starch, a carboxymethyl cellulose, alginic acid, pectic acid, polyvinylalcohol, polyvinylpyrrolidone, a hydroxypropyl cellulose, a hydroxypropylmethyl cellulose, a gelatin, an anionic surface active agent described in JP-A-52-92716, and WO 88/04794, and compounds described in. JP-A-9-179243.

The amount of the organic silver salt which can be used is preferably in the range of from 0.1 to 5 g/m$^2$, and more preferably from 1 to 3 g/m$^2$, in terms of a silver amount. The ratio of a light-sensitive silver halide to a silver organate is preferably in the range of 0.01 mol to 0.5 mol, more preferably from 0.02 mol to 0.3 mol, and especially preferably from 0.03 mol to 0.25 mol, of the light-sensitive silver halide per mol of the organic silver salt.

Preferably a reducing agent for an organic silver salt is incorporated. Preferred of the reducing agent, are phenidone, hydroquinone, catechol, and a hindered phenol reducing agent. The hindered phenol reducing agent is especially preferred. Specific examples thereof include bisphenol and chromanol. The amount of the reducing agent to be incorporated is preferably in the range of from 5 to 50% (mol), and more preferably from 10 to 40% (mol), per mol of silver.

Preferably a color toning agent is added to improve an image quality. Preferably examples of the color toning agent including a cyclic imide, a cobalt complex, mercaptan, phthalazinone, phthalazinone derivatives, phthalazine, and phthalazine derivatives. More preferred of these compounds, are phthalazinone, phthalazinone derivatives, phthalazine, and phthalazine derivatives. Among these compounds, phthalazine and derivatives thereof are especially preferred. The color toning agent is incorporated in a photographic constituent layer on the image-forming layer side preferably in the range of 0.1 to 50% (mol), and more preferably from 0.5 to 20% (mol), per mol of silver.

In order to obtain a high contrast image, it is preferred to use a substituted alkene derivative represented by general formula (1), a substituted isooxazole derivative represented by general formula (2), a specific acetal compound represented by general formula (3), and a hydrazine derivative.

General formula (1)

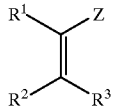

General formula (2)

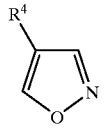

General formula (3)

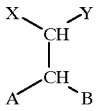

In general formula (1), $R^1$, $R^2$, and $R^3$ each independently represent a hydrogen atom, or a substituent. Z represents an electron withdrawing group, or a silyl group. In general formula (1), $R^1$ and Z, $R^2$ and $R^3$, $R^1$ and $R^2$, or $R^3$ and Z may be connected together to form a ring structure. In general formula (2), $R^4$ represents a substituent. In general formula (3), X and Y each independently represent a hydrogen atom, or a substituent. A and B each independently represent an alkoxy group, an alkylthio group, an alkylamino group, an aryloxy group, an arylthio group, an anilino group, a heterocyclic oxy group, a heterocyclic thio group, or a heterocyclic amino group. In general formula (3), X and Y, or A and B may be connected together to form a ring structure.

Preferred of the compound represented by general formula (1), are compounds in which Z represents a cyano group, a formyl group, an acyl group, alkoxycarbonyl group, an imino group, or a carbamoyl group; $R^1$ represents an electron-withdrawing group, or an aryl group; one of $R^2$ and $R^3$ is a hydrogen atom, and another is a hydroxyl group (or a salt thereof), a mercapto group (or a salt thereof), an alkoxy group, an aryloxy group, a heterocyclic oxy group, an alkylthio group, an arylthio group, a heterocyclic thio group, or a heterocyclic group. Further, preferred compounds are those in which Z and $R^1$ are connected together to form a non-aromatic 5- to 7-membered ring structure, one of $R^2$ and $R^3$ is a hydrogen atom, and another is a hydroxyl group (or a salt thereof), a mercapto group (or a salt thereof), an alkoxy group, an aryloxy group, a heterocyclic oxy group, an alkylthio group, an arylthio group, a heterocyclic thio group, or a heterocyclic group. At this time, Z which connects together with $R^1$ to form a non-aromatic ring structure is preferably an acyl group, a carbamoyl group, an oxycarbonyl group, a thio carbonyl group, a sulfonyl group, and the like, and $R^1$ is preferably an acyl group, a carbamoyl group, an oxycarbonyl group, a thiocarbonyl group, a sulfonyl group, an imino group, a N-atom-substituted imino group, an acylamino group, a carbonyl thio group, and the like.

In general formula (2), the substituent $R^4$ is an electron-withdrawing group, or an aryl group, and preferably is a substituted or unsubstituted phenyl group having 0 to 30 total carbon atoms, a cyano group, an alkoxycarbonyl group, a carbamoyl group, and a heterocyclic group. Among these groups, a cyano group, a heterocyclic group, and an alkoxycarbonyl group are especially preferred.

The substituents represented by X and Y in general formula (3) are groups preferably having 1 to 40 total carbon atoms, and more preferably 1 to 30 total carbon atoms. More preferably exemplified substituents include a cyano group, an alkoxycarbonyl group, a carbamoyl group, an alkylsulfonyl, an arylsulfonyl group, an acyl group, an acylthio group, an acylamino group, a thiocarbonyl group, a formyl group, an imino group, a N atom-substituted imino group, a heterocyclic group, and a phenyl group further substituted with any of an electron-withdrawing group. It is also preferred that X and Y are connected together to form a non-aromatic carbon ring, or a non-aromatic hetero ring. The ring structure formed by X and Y is preferably a 5- to 7-membered ring, and the total carbon atoms thereof are preferably 1 to 40, and more preferably 3 to 30. Preferred examples of X and Y forming a ring structure include an acyl group, a carbamoyl group, an oxycarbonyl group, a thiocarbonyl group, a sulfonyl group, an imino group, a N-substituted imino group, an acylamino group, a carbonylthio group, and the like.

In general formula (3), A and B each independently represent an alkoxy group, an alkylthio group, an alkylamino group, an aryloxy group, an arylthio group, an anilino group, a heterocyclic thio group, a heterocyclic oxy group, or a heterocyclic amino group. The total carbon atom of A or B is preferably 1 to 30. More preferably A and B are connected together to form a ring structure, with a 5- to 7-membered non-aromatic hetero ring being further more preferred. In this case, specific examples of a connection of A and B (—A—B—) include, for example, —O—$(CH_2)_2$—O—, —O—$(CH_2)_3$—O—, —S—$(CH_2)_2$—S—, —S—$(CH_2)_3$—S—, —S-ph-S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$-ph-O—, —N$(CH_3)$-ph-S—, —N(ph)-$(CH_2)_2$—S—, and the like.

The compounds represented by general formula (1) to general formula (3) may have a group capable of adsorption to a silver halide such as an alkyl thio group, an arylthio group, a thiourea group, a thioamide group, a mercapto heterocyclic group, and a triazole group.

More preferably, the compounds represented by general formula (1) to general formula (3) have a ballast group such as an alkyl group, an aralkyl group, an alkoxy group, a phenyl group, an alkylphenyl group, a phenoxy group, and an alkylphenoxy group.

More preferably, the compounds represented by general formula (1) to general formula (3) contain therein a cationic group (e.g a group containing a quaternary ammonium group or a nitrogen-containing heterocyclic group containing a quaternary nitrogen atom), a group containing a recurring unit of an ethylene oxy group or a propylene oxy group, an (alkyl, aryl, or heterocyclic) thio group, or a dissociating group capable of dissociating with a base (e.g. a carboxy group, a sulfo group, an acylsulfamoyl group, or a carbamoylsulfamoyl group). Particularly preferred of these compounds, are those having a group containing a recurring unit of an ethylene oxy group or a propyleneoxy group, or an (alkyl, aryl, or heterocyclic) thio group.

The amount of the compounds represented by general formula (1) to general formula (3) for use in the present invention, is preferably in the range of from $1\times10^{-6}$ to 1 mol, more preferably from $1\times10^{-5}$ to $5\times10^{-1}$, and most preferably from $2\times10^{-5}$ to $2\times10^{-1}$ mol.

Preferably a hydrazine derivative represented by general formula (H) shown below is used as an ultrahigh contrasting agent.

$$R^{12}—NA^1—NA^2—(G^1)_{m1}—R^{11} \quad (H)$$

In general formula (H), $R^{12}$ represents an aliphatic group, an aromatic group, or a heterocyclic group. The aliphatic group is preferably an alkyl group having 1 to 30 carbon atoms, an alkenyl group, and an alkynyl group. The aromatic group is a monocyclic or condensed ring system aryl group. Exemplified aryl group includes a phenyl group and a naphthyl group. The heterocyclic group is a monocyclic or condensed ring system, saturated or unsaturated, aromatic or non-aromatic heterocyclic group. Preferred of these groups, are an aryl group and an alkyl group.

Preferable examples of a substituent that $R^{12}$ may have, are explained below.

In the case where $R^{12}$ represents an aliphatic group, preferable examples of the substituent include an alkyl group, a aryl group, a heterocyclic group, an amino group, an acylamino group, a sulfonamide group, an ureido group, a sulfamoylamino group, an imido group, a thio ureido group, a phosphoric acid amide, a hydroxyl group, an alkoxy group, an aryloxy group, an acyloxy group, an acyl group, an alkoxycarbonyl group, an aryloxycarbonyl group, a carbamoyl group, a carboxyl group (including a salt thereof), an (alkyl, aryl, or heterocyclic) thio group, a sulfo group (including a salt thereof), a sulfamoyl group, a halogen atom, a cyano group, and a nitro group. In the case where $R^{12}$ represents an aromatic group or a heterocyclic group, preferable examples of the substitute include an alkyl group (including an active methylene group), an aralkyl group, a heterocyclic group, a substituted amino group, an acylamino group, a sulfonamide group, an ureido group, a sulfamoylamino group, an imide group, a thioureido group, a phosphoric acid amide group, hydroxyl group, an alkoxy group, an aryloxy group, an acyloxy group, an acyl group, an alkoxycarbonyl group, an aryloxycarbonyl group, a carbamoyl group, a carboxyl group (including a salt thereof), an (alkyl, aryl, or a heterocyclic) thio group, a sulfo group (including a salt thereof), a sulfamoyl group, a halogen atom, a cyano group, and a nitro group.

$R^{11}$ represents a hydrogen atom, or a block group. The block group represents an aliphatic group (specifically an alkyl group, an alkenyl group, an alkynyl group), an aromatic group (a monocyclic or condensed ring system aryl group), a heterocyclic group, an alkoxy group, an aryloxy group, an amino group, or a hydrazino group. $R^{11}$ may have a substituent. Examples of the substituent are those exemplified by $R^{12}$.

$A^1$ and $A^2$ each represent a hydrogen atom, or one of $A^1$ and $A^2$ is a hydrogen atom, and another represents an alkylsulfonyl group having up to 20 carbon atoms, an arylsulfonyl group (preferably a phenylsulfonyl group, or a phenylsulfonyl group substituted with such a substituent that the sum of Hammett's substituent constant becomes −0.5 or more), or an acyl group (preferably a benzoyl group, or a benzoyl group substituted with such a substituent that the sum of Hammett's substituent constant becomes −0.5 or more, or an aliphatic acyl group). ml is 0 or 1, and when m1 is 0, $R^{11}$ represents an aliphatic group, an aromatic group, or a heterocyclic group. Most preferably, $A^1$ and $A^2$ are a hydrogen atom.

G represents —CO—, —COCO—, —C(=S)—, —$SO_2$—, —SO—, —PO($R^{13}$)— groups ($R^{13}$ is selected from the same groups as defined by $R^{11}$, and $R^{13}$ may be different from $R^{11}$), or an iminomethylene group.

The hydrazine derivative represented by general formula (H) may have a group adsorptive to silver halide (e.g. an alkylthio group, an arylthio group, a thiourea group, a thioamide group, a mercapto heterocyclic group, a triazole group.)

$R^{11}$ or $R^{12}$ in general formula (H) may have a ballast group such as an alkyl group, an aralkyl group, an alkoxy group, a phenyl group, an alkylphenyl group, a phenoxy group, and an alkylphenoxy group, or a polymer described in JP-A-1-100530.

$R^{11}$ or $R^{12}$ in general formula (H) may contain therein a cationic group (e.g. a group containing a quaternary ammonium group, or a nitrogen-containing heterocyclic group containing a quaternary nitrogen atom), a group containing a recurring unit of an ethyleneoxy group or a propyleneoxy group, an (alkyl, aryl, or heterocyclic) thio group, or a dissociating group capable of dissociating with a base (e.g. a carboxyl group, a sulfo group, an acylsulfamoyl group, a carbamoylsulfamoyl group).

The addition amount of hydrazine derivatives for use in the present invention is preferably in the range of from $1\times10^{-6}$ to $1\times10^{-2}$ mol, more preferably from $1\times10^{-5}$ to $5\times10^{-3}$ mol, and most preferably from $2\times10^{-5}$ to $5\times10^{-3}$ mol, per mol of silver.

Further, in order to form an ultrahigh contrast image in the present invention, a high contrast accelerator may be used in combination with the above-described ultrahigh contrasting agent. For example, amine compounds described in U.S. Pat. No. 5,545,505, hydroxamic acids described in U.S. Pat. No. 5,545,507, acrylonitriles described in U.S. Pat. No. 5,545,507, hydrazine compounds described in U.S. Pat. No. 5,558,983, and onium salts described in JP-A-9-297368 can be used.

As a sensitizing dye in the present invention, the use can be made of a cyanine dye, a merocyanine dye, a complex cyanine dye, a complex merocyanine dye, a holopolarcyanine dye, styryl dye, a hemicyanine dye, an oxonol dye, and a hemioxonol dye.

As an example of spectral sensitization to a red light, the use can be made of compounds described in JP-A-54-18726, JP-A-6-75322, JP-A-7-287338, JP-B-55-39818, JP-A-62-284343, and JP-A-7-287338, to a red light source such as a He-Ne laser, a red semiconductor laser, and LED.

To a semi conductor laser light source in the wavelength region of 750 to 1400 nm, spectral sensitization can be advantageously carried out by a various kind of known dyes including a cyanine, merocyanine, styryl, hemicyanine, oxonol, hemioxonol, and xanthene dye.

Further, the compounds described in the U.S. Pat. Nos. 5,510,236 and 3,871,887, JP-A-2-96131. and JP-A-59-48753 can be preferably used as a dye capable of forming a J-band.

The amount of the sensitizing dye for use in the present invention is preferably in the range of from $10^{-6}$ to 1 mol, and more preferably from $10^{-4}$ to $10^{-1}$ mol, per mol of silver halide in a light-sensitive layer.

Examples of antifogging agents, stabilizers and precursors of the stabilizer include thiazonium salts described in U.S. Pat. Nos. 2,131,038, and 2,694,716; azaindenes described in U.S. Pat. Nos. 2,886,437 and 2,444,605; a mercury salt described in U.S. Pat. No. 2,728,663; urazols described in U.S. Pat. No. 3,287,135; sulfo catechol described in U.S. Pat. No. 3,235,652; oximes, nitrons, and nitoroindazoles described in Great Britain Patent No. 623,448; polyvalence metal salts described in U.S. Pat. No. 2,839,405; thiouronium salts described in U.S. Pat. No. 3,220,839; palladium, platinum and gold salts described in U.S. Pat. Nos. 2,566,263 and 2,597,915; halogen-substituted organic compounds described in U.S. Pat. Nos. 4,108,665 and 4,442,202; triazines described in U.S. Pat. Nos. 4,128,557; 4,137,079; 4,138,365, and 4,459,350; and phosphorus compounds described in U.S. Pat. No. 4,411,985.

Further, benzoic acids may be incorporated for the purpose of achieving an antifogging and a high speed. Preferable examples of the structure of the benzoic acids include compounds described in, for example, U.S. Pat. Nos. 4,784,939 and 4,152,160, JP-A-9-329865, JP-A-9-329864, and JP-A-9-281637. These compounds are preferably added to an organic silver salt-containing layer. The amount of the compound added is preferably in the range of from 1 μmol to 2 mol, and more preferably from 1 mmol to 0.5 mol, per mol of silver.

In the present invention, mercapto compounds, disulfide compounds, and thion compounds can be incorporated for the purposes of controlling a development by restraining or accelerating the development; or improving a spectral sensitization efficiency; or improving storage stability.

The mercapto compound is preferably a mercapto-substituted heteroaromatic compound, with specific examples including 2-mercapto benzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-benzothiazole, 3-mercapto-1,2,4-triazole, 4,5-diphenyl-2-imidazolethiol, 2-mercaptoimidazole, 1-ethyl-2-mercapto benzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidinemonohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino- 2-mercaptopyrimidine, 2-mercapto-4-methylpyrimidine hydrochloride, 3-mercapto-5-phenyl-1,2,4-triazole, and 2-mercapto-4-phenyl oxazole. The amount of these mercapto compounds used is preferably in the range of from 0.0001 to 1.0 mol, and more preferably from 0.001 to 0.3 mol, per mol of silver in a photographic emulsion layer.

In an image-forming layer, there may be used polyhydric alcohols (e.g. a variety of glycerols and diols described in U.S. Pat. No. 2,960,404); fatty acids and esters thereof described in U.S. Pat. Nos. 2,588,765 and 3,121,060; silicon resins described in Great Britain Patent No. 955,061, and the like, which serve as a plasticizer and a lubricant.

In a light-sensitive layer which is an image-forming layer, there may be used various kinds of dyestuffs and pigments from the view points of improvement of color tone and prevention of irradiation. Preferable examples of dyestuffs include anthraquinone dyes (e.g. compounds described in JP-A-5-341441 and JP-A-5-165147), azomethine dyes (e.g.

compounds described in JP-A-5-341441), indoaniline dyes (e.g. compounds described in JP-A-5-289227, JP-A-5-341441, JP-A-5-165147), and azo dyes (e.g. JP-A-5-341441). The amount of these compounds which can be used is preferably in the range of 1 $\mu$g to 1 g, per $m^2$ of the light-sensitive material.

An anti-halation layer can be applied to the side further from a light source, on the basis of a light-sensitive layer. The anti-halation layer preferably has a maximum absorption of 0.3 to 2 in a desired wavelength range, more preferably an absorbance of 0.5 to 2 at the wavelength for exposure to light, and preferably an absorbance of 0.001 to less than 0.5 in the visible range after processing. More preferably it is an anti-halation layer having an optical density of 0.001 to less than 0.3. Where anti-halation dyestuffs are used solely, exemplary anti-halation dyes are the compounds described in JP-A-59-56458, JP-A-2-216140, JP-A-7-13295, JP-A-7-11432, U.S. Pat. No. 5,380,635, JP-A-2-68539, JP-A-3-24539, and the like. As a dyestuff decolorizable upon a processing, preferably the use can be made of the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734, U.S. Pat. Nos. 4,088,497, 4,283,487, 4,548,896 and 5,187,049.

Preferably a protective layer can be applied as an outermost layer of the light-sensitive layer. With respect to the binder for the protective layer, acryl-series, acryl/styrene-series, vinyl chloride-series, or vinylidene chloride-series polymer latexes are preferably used. Specific examples of the binders which can be preferably used, include VONCORT R 3370, 4280, and Nipol Lx857, all of which are acryl resins; methylmethacrylate/2-ethylhexylacrylate/hydroxyethyl methacrylate/styrene/acrylic acid copolymer; Nipol G 576, which is a vinyl chloride resin; and Aron D 5071, which is a vinylidene chloride resin. It is more preferred that a crosslinking agent such as an isocyanate be added to these layers. A coating amount of the protective layer is preferably in the range of from 0.5 to 10 g/$m^2$, more preferably from 1 to 7 g/$m^2$, and further more preferably from 1.5 to 5 g/$m^2$.

Further more preferably, a matte agent is added to the protective layer. Examples of inorganic matte agents include silicon dioxide; oxides of titanium, and aluminum; carbonates of zinc, and calcium; sulfates of barium, and calcium; and silicates of calcium, and aluminum, and examples of organic matte agents include organic polymer matte agents such as cellulose esters, polymethylmethacrylate, polystyrene, or polydivinylbenzene, and copolymers thereof. Two or more kinds of these matte agents may be used in combination. The average grain size of the matte agent is preferably in the range of 1 to 10 $\mu$m, and the amount of the matte agent added is preferably in the range of from 5 to 400 mg/$m^2$, and especially from 10 to 200 mg/$m^2$.

The heat-developable image-recording material (heat-developable light-sensitive material) of the present invention is preferably a so-called one side image-recording material having at least one image-forming layer (light-sensitive layer) such as a light-sensitive layer containing a silver halide emulsion on one surface of a support and a back layer (backing layer) on the other side.

In the present invention, the back layer preferably has a maximum absorbance of 0.3 to 2 in a desired wavelength range, more preferably a maximum absorbance of 0.5 to 2 and an absorbance of 0.001 to less than 0.5 in the visible range after a processing. More preferably it is a layer having an optical density of 0.001 to less than 0.3.

Further, examples of anti-halation dyestuffs which are used in a back layer are the same as those used in the above-mentioned anti-halation layer.

As an electrification-regulating agent, electrically conductive fine grains of crystalline metal oxides or composite oxides thereof are preferably added, to make a surface resistivity of $10^{12}$ Ω or less. These electrically conductive fine grains of crystalline metal oxides or their composite oxides, preferably have a volume resistivity of $10^7$ Ωcm or less, more preferably $10^5$ Ωcm or less. Further, their grain size is preferably from 0.01 to 0.7 $\mu$m, and particularly preferably from 0.02 to 0.5 $\mu$m.

A method of producing these electrically conductive fine grains of crystalline metal oxides or composite oxides is fully described in a specification of JP-A-56-143430. For example, the first method, in which metal oxide fine grains are produced by burning, and then they are subjected to a heat treatment in the presence of a hetero atom that gives improved electrical conductivity; the second method, in which a hetero atom, for improving electrical conductivity, is coexisted when metal oxide fine grains are produced by burning; and the third method, in which an oxygen defect is formed by reducing the oxygen density in the atmosphere, when metal fine grains are produced by burning; and the like, are easily carried out. Examples of composite oxides containing metal atoms include ZnO containing Al, In, or the like; $TiO_2$ containing Nb, Ta, or the like; and $SnO_2$ containing Sb, Nb, halogen elements, or the like. The amount of hetero atoms to be added is preferably from 0.01 to 30 mol %, and particularly preferably from 0.1 to 10 mol %. $SnO_2$ composite metal oxide fine grains to which Sb is added, are most preferred of these grains.

Fine particles are preferably added in order to make the back surface matte. Examples of the fine particles include inorganic fine particles (e.g. silica, alumina, calcium carbonate, titania, and zirconia), and organic fine particles (e.g. PMMA, PSt, and crosslinked materials thereof). It is more preferred in the present invention to use a porous matte agent described in JP-A-3-109542, page 2, left lower column line 8 to page 3, right upper column line 4, a matte agent whose surface is modified with an alkali, described in JP-A-4-127142, page 3, right upper column line 7 to page 5, right lower column line 4, and a matte agent of the organic polymer type, described in JP-A-6-118542, paragraph Nos. 0005 to 0026. The grain size of the fine particles is preferably in the range of from 0.3 $\mu$m to 10 $\mu$m, more preferably from 1 $\mu$m to 8 $\mu$m, and further more preferably from 3 $\mu$m to 7 $\mu$m. The amount of the fine particles added is preferably in the range of from 1 to 50 mg/$m^2$, more preferably from 2 to 30 mg/$m^2{}_1$, and further more preferably from 3 to 15 mg/$m^2$. The back layer thus achieved should preferably have a degree of matte as expressed by a Bekk smoothness (JIS P8119) of up to 2,000 seconds, and more preferably 10 to 2,000 seconds.

These back layers may contain a hydrophilic colloid or a hydrophobic polymers as a binder.

The most preferable hydrophilic polymer is gelatin. Where a hydrophilic polymer is used, preferably a back layer is coated after the same under coating as in the light-sensitive layer, to thereby impart a solid adhesion.

As a hydrophobic polyer binder, there can be used (meth) acrylic acid ester polymers such as polymethylmethacrylate, and ethylacrylate; olefin-series polymers such as polyethylene; styrene-series polymers; urethane-series polymers; and rubber-series polymers such as butadiene. These back layers may be a single layer, or a plurality of layers. Further, the back layer may be hardened with a hardening agent. Examples of the hardening agent which can be used, include polyisocyanates described in U.S. Pat. No. 4,281,060, and JP-A-6-208193; epoxy compounds described in U.S. Pat. No. 4,791,042; and vinylsulfone compounds described in JP-A-62-89048.

A surface protective layer may be provided as an outermost layer of the back layers. The total amount of a binder for the surface protective layer is preferably in the range of from 0.2 to 5.0 g/m$^2$, and more preferably from 0.5 to 3.0 g/m$^2$. As a binder for the back layer, there can be used acrylic-series, olefin-series, and vinylidene chloride-series polymer latexes, with specific preferable examples thereof including Jurimer ET-410, Sevian A-4635, POLYZOL F410, or the like, all of which comprises acrylic resin-series; Chemipearl S 120 which comprises olefin resin-series, L 502, and ARON D 7020, each of which comprises vinylidene chloride-series polymer.

Preferably, the back layer should contain a fluorine-containing surface active agent. Preferable examples thereof include surface active agents having a fluoroalkyl group having 4 or more (preferably 4 to 15) carbon atoms, a fluoroalkenyl group or a fluoroaryl group, and further having, as an ionic group, an anion group (e.g. a sulfonic acid (salt), a sulfuric acid (salt), a carboxylic acid (salt), a phosphoric acid (salt)), a cationic group (e.g. an amine salt, an ammonium salt, an aromatic amine salt, a sulfonium salt, a phosphonium salt), a betain group (e.g. a carboxylamine salt, a carboxyammonium salt, a sulfoamine salt, a sulfoammonium salt, a phosphoammonium salt), or a nonionic group (e.g. a substituted or unsubstituted polyoxyalkylene group, a polyglyceryl group, or a sorbitan residual group). These fluorine-containing surface active agents are described in, for example, JP-A-49-10722, British Patent No. 1,330,356, U.S. Pat. Nos. 4,335,201, and 4,347,308, British patent No. 1,417,915, JP-A-55-149938, JP-A-58-196544, and British patent No. 1,439,402. Two or more kinds of these fluorine-containing surface active agents may be mixed together.

The amount of the fluorine-containing surface active agent which can be used is preferably in the range of from 0.0001 to 1 g, more preferably from 0.0002 to 0.25 g, and especially preferably from 0.0003 to 0.1 g, per 1 m$^2$ of the image-recording material.

An outermost layer of the back layer should more preferably contain a sliding (slipping) agent. Typically, exemplified sliding agents are silicone-series sliding agents, higher fatty acid-, alcohol-, or acid amide-series sliding agents, a metal soap, ester-, and ether-series sliding agents, and taurin-series sliding agents. Specific examples of the sliding agent which can be preferably used, include Serosol 524 (primary ingredient: carnauba wax), Polyron A, 393, H-481 (primary ingredient: polyethylene wax), Hymicron G-110 (primary ingredient: ethylene bisstearic acid amide), Hymicron G-270 (primary ingredient: stearic acid amide), all of which are trade names, and manufactured by Chukyo Yushi Co., Ltd.

The amount of the sliding agent which can be used, is preferably in the range of from 0.1 to 50 wt. %, and more preferably from 0.5 to 30 wt. %, based on the amount of a binder of the layer to which the sliding agent is added.

Such a back layer may be a single layer, or multi-layers. The thickness of each of the back layers is preferably in the range of from 0.02 to 10 $\mu$m, and more preferably from 0.1 to 7 $\mu$m. The total thickness of these layers is preferably in the range of 0 to 5 $\mu$m.

These back layer and under coating layer can be coated by a dip coating method, an air-knife coating method, a curtain coating method, a roll coating method, a wire bar coating method, and a gravure coating method, though not limited thereto. These layers may be coated separately (one by one), or alternatively two or more of these layers may be coated at a time.

The thus-prepared heat-developable light-sensitive material is cut at the time of use. The light-sensitive material may be used in a roll form, or in a sheet form. In both cases, the width (a direction crossing at a right angle to the processing direction, when a light-sensitive material is passed through a heat processor) of the light-sensitive material is preferably in a range of from 40 cm to 150 cm, more preferably from 45 cm to 100 cm, and further more preferably from 50 cm to 80 cm.

A heat-developable image-recording material of the present invention may be exposed by any one of methods. However, a laser light is preferred as an exposure light source. As a laser light for use in the present invention, a gas laser, a YAG laser, a dye laser, a semiconductor laser are preferred, though not limited thereto. Further, the semiconductor laser, a second higher harmonics-generating device, and the like can be used in combination, though not limited thereto.

The heat-developable image-recording material of the present invention produces a reduced haze at the time of exposure, and an interference fringe tends to easily occur. As a technology for preventing such an interference fringe, there are known a method for irradiating a laser light diagonally to the image-recording material described in, for example, JP-A-5-113548, and a method for applying a multimode laser described in, for example, WO 95/31754, and these methods can be preferably used.

Upon exposure to the heat-developable image-recording material, it is preferred that exposure should be performed so that laser beams can be overlapped, and thereby a scanning line be not seen, as described in, for example, SPIE vol. 169 Laser Printing, pp. 116 to 128 (1979), JP-A-4-51043, and WO 95/31754.

The heat-developable image-recording material of the present invention may be subjected to heat development by any of the known methods. Usually, a heat-developable image-recording material having been exposed imagewise is developed by elevating a temperature according to the above-described method.

The measurement method of the physical properties defined in the present invention is described below. Herein, the measurement methods (1) and (2) are explained with reference to drawings.

Figure 2:
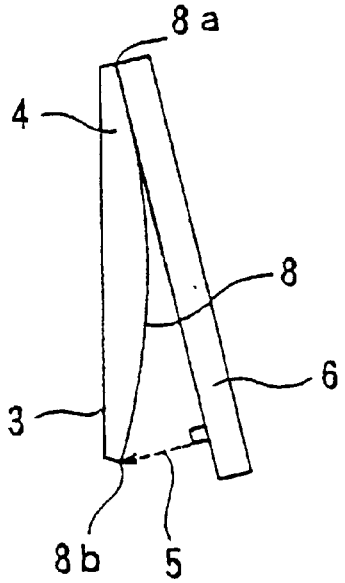
FIG. 2 is an explanatory view illustrating a method for measuring the degree of warp in the present invention.

(1) Measurement of the Degree of Warp at the Edge Portion of Each of Four Sides After Heat Development (refer to FIGS. 1 and 2)

① A heat-developable light-sensitive material, cut to the size of 50 cm on each of four sides, is subjected to heat development at the predetermined conditions. Thereafter, as shown in FIG. 1, the edge portion of four sides of the light-sensitive material 1, after such heat development, is slit at the slit portion 2, at a width of 1 cm. When slit, bending (undulation) is eliminated from the side 8 of the single slit 4, owing to the slitting. As a result, the side 8 becomes circular arc-like, as shown in FIG. 2.

② As shown in FIG. 2, one end 8*a* of side 8 opposite to side 3 of the single slit 4 is put on one side of ruler 6, and the gap (distance) 5 between the other end 8*b* of side 8 and the ruler is measured. Similarly, the end 8*b* is put on the ruler, and the gap between end 8*a* and the ruler is measured. The average value of these values is defined as the degree of warp (mm/50 cm). This value is measured with respect to four sides.

Herein, when the size of each of four sides of the light-sensitive material is not 50 cm, after each of the sides was slit to a width of 1 cm, the degree of warp (A) is measured according to the above-described method, followed by correction according to the formula shown below.

Degree of warp (mm/50 cm) =A(mm)×{50/side length (cm) of the light-sensitive material}

Figure 3:
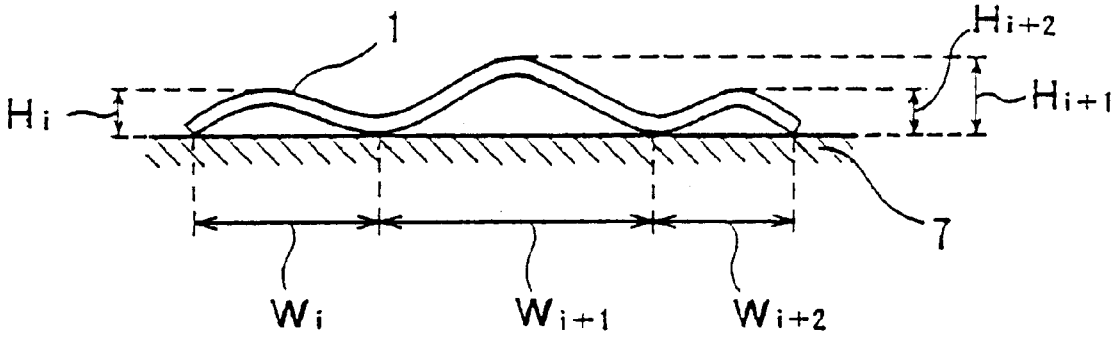
FIG. 3 is a diagrammatic view showing a state of undulation at a surface of the edge portion of the light-sensitive material as that of the four sides in the present invention.

(2) Measurement of the Degree of Undulation at the Edge Portion of Each of Four Sides after Heat Development (Refer to FIG. 3)

① A heat-developable light-sensitive material, cut to the size of 50 cm on each of four sides, is subjected to heat development at the predetermined conditions. The heat-developable light-sensitive material 1, after the heat development, is placed on a flat stand 7 disposed horizontally, so that the light-sensitive layer is arranged at the upside.

② After three minutes, the degree of undulation in each of four sides is measured as described below.

At every undulation generated on the side, both the maximum height ($H_i$ mm) and width ($W_i$ mm) thereof are measured using a ruler, a slide calipers, or the like. Herein, FIG. 3 is a schematic view exemplifying undulations when i represents each of i, i+1, and i+2, concerning the above-described $H_i$ and $W_i$. That is, in FIG. 3, $H_i$ represents the maximum height of a certain occurred undulation i, $H_{i+1}$ represents the maximum height of a certain occurred undulation i+l, $H_{i+2}$ represents the maximum height of a certain occurred undulation i+2, $W_i$ represents the width of a certain occurred undulation i, $W_{i+1}$ represents the width of a certain occurred undulation i+1, and $W_{i+2}$ represents the width of a certain occurred undulation i+2.

At each of four sides, $H_i$(mm)×$W_i$(mm) is added up according to the following formula, and such an integrated value is defined as the degree of undulation at the edge portion of each of four sides (mm²/50 cm).

$$\text{Degree of Undulation} = \sum_i (H_i \times W_i)$$

Herein, when the size of each of four sides of the light-sensitive material is not 50 cm, the degree of undulation (B) is measured according to the above-described method, followed by correction according to the formula described below.

Degree of Undulation=B(mm²)×{50/side length (cm) of light-sensitive Material}

(3) Thermal Dimensional Changing Ratio at 120° C. for 30 Seconds

① A heat-developable light-sensitive material is cut to the size of 5 cm in the transverse direction (TD), and 25 cm in the longitudinal direction (MD), and the thus-obtained strip is supplied as a sample along the MD direction. Similarly, a heat-developable light-sensitive material is cut to the size 25 cm in the transverse direction (TD), and 5 cm in the longitudinal direction (MD), and the thus-obtained strip is supplied as a sample along the TD direction.

② After humidifying each sample at 25° C. and 60% RH for 12 hours, two holes, with an interval of 20 cm, are formed, and then the interval is measured using a pin gauge (the length is defined as $L_1$(mm)).

③ These samples are heated by allowing them to contact, for 30 seconds, a heat bock heated at 120° C., in the absence of tension.

④ After humidifying each sample at 25° C. and 60% RH for 12 hours, the interval is measured using a pin gauge (the length is defined as $L_2$(mm)).

⑤ The thermal dimensional changing ratio at 120° C. for 30 seconds is obtained based on the following formula.

Thermal dimensional changing ratio (%) at 120° C. for 30 seconds=$100\times(L_2-L_1)/L_1$ (4) Water-absorbing Dimensional Changing Ratio after Heat-development at 120° C. for 30 Seconds ① A heat-developable light-sensitive material is cut to the size of 5 cm in the transverse direction (TD), and 25 cm in the longitudinal direction (MD), and the thus-obtained strip is supplied as a sample along the MD direction. Similarly, a heat-developable light-sensitive material is cut to the size of 25 cm in the transverse direction (TD), and 5 cm in the longitudinal direction (MD), and the thus-obtained strip is supplied as a sample along the TD direction.

② After humidifying each sample at 25° C. and 40% RH for 12 hours, two holes, with an interval of 20 cm, are formed, and then the interval is measured using a pin gauge (the length is defined as $L_0$(mm)).

③ These samples are subjected to heat development using a heat processor set up at 25° C. and 75% RH. The heat development is carried out by allowing them to contact a heat block heated at 120° C. for 30 seconds, to heat, in the absence of tension.

④ At 25° C. and 75% RH, the size ($L_3$) of the interval after three minutes from the heat development, and the size ($L_{120}$) after 120 minutes from the heat development, are measured using a pin gauge.

⑤ The water-absorbing dimensional changing ratio after heat development at 120° C. for 30 seconds is obtained, based on the following formula.

Water-absorbing dimensional changing ratio (%) after heat development at 120° C. for 30 seconds=$\{100\times(L_{120}-L_0)/L_0\}-\{100\times(L_3-L_0)/L_0\}$ A heat-developable photographic light-sensitive material of the present invention exhibits such an excellent effect that the planar property after a heat development is good, and consequently the problem of printing blur does not occur, not only in ordinary use but also even in use as a light-sensitive material for printing. Further, a heat-development method of the present invention exerts an excellent effect as a method for maintaining excellent planar property and consequently restraining the occurrence of the printing blur problem, when a heat-developable photographic light-sensitive material of the present invention is subjected to heat development.

EXAMPLES

The present invention will be described in detail with reference to the following Examples, but the invention should not be construed as being limited thereto.

Example 1

(1) Preparation of Support (base)

Using terephthalic acid and ethylene glycol, PET of IV=0.66 (measured in phenol/tetrachloroethane=6/4 (weight ratio) at 25° C.) was obtained according to an ordinary method. After forming pellets from the PET and drying at 130° C. for 4 hours, the pellets were extruded from a T-type die after melting at 300° C. followed by quenching to provide an unstretched film of a thickness which become 120 μm after thermal fixing.

The film was longitudinally stretched to 3.3 times using rolls each having a different peripheral speed, then lateral direction stretching to 4.5 times was practiced by a tenter, and the temperature in this case were 110° C. and 130° C. respectively. Thereafter, after thermally fixing at 240° C. for 20 seconds, the sample film was mitigated by 4% to the lateral direction at the same temperature. Thereafter, after slitting the chuck portion of the tenter, knurl working was applied to both ends and the film was wound at 4.8 kg/cm$^2$. Thus, the rolled film having a width of 2.4 meters, a length of 3,500 m, and a film thickness of 120 μm was obtained.

(2) Undercoating Layer

An undercoating layer (a-1) or (a-2) having the following composition as shown in Table 1, was coated on the both surfaces of the support. Thereafter, an undercoating layer (b) was successively coated on the both surfaces. They were then dried at 180° C. for 4 minutes respectively. A coating solution for the undercoating layer (a-1) or (a-2) was coated such that the layer thickness after drying became the values shown in Table 1, while the undercoating layer (b) was coated so as to be a dry thickness of 1.0 μm.

| (2-1) Undercoating layer (a-1) | |
|---|---|
| PVdC polymer latex<br>A core/shell type latex composed of a core part (90 wt. %) and a shell part (10 wt. %)<br>The core part: Vinylidene chloride/Methyl acrylate/Methyl methacrylate/Acrylonitrile/Acrylic acid = 93/3/3/0.9/0.1 (wt. %)<br>The shell part: Vinylidene chloride/Methyl acrylate/Methyl methacrylate/Acrylonitrile/Acrylic acid = 88/3/3/3/3 (wt. %) | 3,000 weight parts |
| 2,4-Dichloro-6-hydroxy-s-triazine | 23 weight parts |
| Matte agent (Polystyrene, average particle size 2.4 μm) | 1.5 weight parts |
| **(2-2) Undercoating layer (a-2)** | |
| SBR polymer latex<br>Styrene/Butadiene/Hydroxyethylmethacrylate/Divinylbenzene = 67/30/2.5/0.5 (wt. %) | 160 weight parts |
| 2,4-Dichloro-6-hydroxy-s-triazine | 4 weight parts |
| Matte agent (Polystyrene, average particle size 2.4 μm) | 3 weight parts |

-continued

| (2-3) undercoating layer (b) | |
|---|---|
| Alkali-treated gelatin<br>($Ca^{++}$ content 30 ppm, jelly strength 230 g) | 50 mg/m$^2$ |

(3) Back Layer

On one side of the support coating theabove-described undercoating layer (a-1) or (a-2) and (b) on both the surfaces thereof, the following electro conductive layer and protective layer were coated successively, and they were dried at 180° C. for 4 minutes respectively, to prepare a PET support having thereon a back layer/undercoating layers.

| (3-1) Electro conductive layer (Surface resistivity at 25° C. and 25% RH $10^9\Omega$) | |
|---|---|
| Jurimer ET-410 (trade name, manufactured by Nihon Junyaku K. K.): Tg = 52° C. | 38 mg/m$^2$ |
| $SnO_2$/Sb (9/1 weight ratio, average particle size 0.25 μm) | 120 mg/m$^2$ |
| Matte agent (polymethylmethacrylate, average particle size 5 μm) | 7 mg/m$^2$ |
| Denacol EX-614B (trade name, manufactured by Nagase Kasei Chemicals Ltd.) | 13 mg/m$^2$ |
| **(3-2) Protective layer** | |
| Chemipearl S-120 (trade name, manufactured by Mitsui Chemicals, Inc.): Tg = 77° C. | 500 mg/m$^2$ |
| Snowtex-C (trade name, manutactured by Nissan Chemipearl Industries, Ltd.) | 40 mg/m$^2$ |
| Denacol EX-614B (manufactured by Nagase Kasei Chemicals Ltd.) | 30 mg/m$^2$ |

(4) Heat Treatment

The PET support having thereon a back layer/undercoating layers, was subjected to a heat treatment by allowing them to convey (pass) through a heating zone maintained at the temperature and the tension for the period of time as each shown in Table 1.

TABLE 1

| | Undercoating layer | | Heat-treatment condition | | | Thermal dimensional change at 120° C. for 30 seconds (%) | | Water-absorbing dimensional changing rate after heat development (%/2 hrs) | |
|---|---|---|---|---|---|---|---|---|---|
| Level | Kinds | Thickness of PVdC layer (μm) | Temperature (° C.) | Tension (kg/m) | Time (second) | MD | TD | MD | TD |
| This invention-1 | a-1 | 1.8 | 160 | 2.0 | 80 | −0.01 | +0.02 | +0.007 | +0.005 |
| This invention-2 | a-2 | 0 | 175 | 0.3 | 240 | +0.01 | +0.02 | +0.024 | +0.023 |
| This invention-3 | a-1 | 8.0 | 145 | 4.6 | 23 | −0.04 | +0.04 | +0.001 | +0.001 |
| This invention-4 | a-1 | 0.8 | 155 | 1.0 | 50 | 0.00 | +0.03 | +0.015 | +0.012 |
| This invention-5 | a-1 | 3.8 | 165 | 2.8 | 120 | −0.02 | +0.02 | +0.004 | +0.003 |
| This invention-6 | a-1 | 1.2 | 150 | 1.5 | 180 | −0.01 | +0.01 | +0.010 | +0.009 |
| This invention-7 | a-1 | 2.2 | Not heat-treated | | | −0.08 | −0.06 | +0.005 | +0.004 |
| This invention-8 | a-1 | 2.5 | 170 | 0.8 | 200 | 0.00 | +0.01 | +0.004 | +0.004 |
| This invention-9 | a-1 | 1.7 | 165 | 2.0 | 82 | −0.01 | +0.02 | +0.008 | +0.004 |
| This invention-10 | a-2 | 0 | 170 | 0.4 | 245 | +0.01 | +0.01 | +0.026 | +0.025 |
| This invention-11 | a-1 | 8.1 | 145 | 4.5 | 20 | −0.03 | +0.03 | +0.001 | +0.001 |
| This invention-12 | a-1 | 0.8 | 155 | 1.1 | 55 | 0.00 | +0.04 | +0.016 | +0.014 |
| This invention-13 | a-1 | 3.9 | 160 | 2.7 | 128 | −0.03 | +0.02 | +0.005 | +0.004 |

TABLE 1-continued

| Level | Undercoating layer Kinds | Thickness of PVdC layer (μm) | Heat-treatment condition Temperature (° C.) | Tension (kg/m) | Time (second) | Thermal dimensional change at 120° C. for 30 seconds (%) MD | TD | Water-absorbing dimensional changing rate after heat development (%/2 hrs) MD | TD |
|---|---|---|---|---|---|---|---|---|---|
| This invention-14 | a-1 | 1.1 | 155 | 1.6 | 183 | −0.01 | +0.02 | +0.011 | +0.008 |
| This invention-15 | a-1 | 2.3 | Not heat-treated | | | −0.09 | −0.07 | +0.006 | +0.003 |
| This invention-16 | a-1 | 2.6 | 171 | 0.9 | 205 | 0.08 | +0.01 | +0.003 | +0.003 |
| Comparative example-1 | a-2 | 0 | 135 | 5.5 | 18 | −0.07 | +0.06 | +0.026 | +0.026 |

TABLE 2

| Level | Heat-development condition: Rate of elevating temperature (° C./second) | Part of constant temperature: Temperature (° C.) | Distribution of temperature (° C.) | Rate of lowering temperature (° C./second) | Degree of warp after heat development (mm/50 cm): Front edge | Back edge | Left edge | Right edge | Degree of undulation after heat development ($mm^2$/50 cm): Front edge | Back edge | Left edge | Right edge | Ratio of dot failure (%) |
|---|---|---|---|---|---|---|---|---|---|---|---|---|---|
| This invention-1 | +3.0 | 120 | 0.5 | −2.0 | 0.3 | 0.1 | 0.2 | 0.2 | 20 | 0 | 10 | 20 | 0 |
| This invention-2 | +1.5 | 115 | 0 | −1.5 | 3.6 | 2.5 | 1.8 | 1.8 | 460 | 280 | 180 | 160 | 2 |
| This invention-3 | +2.0 | 110 | 2.3 | −2.5 | 1.8 | 0.4 | 0.3 | 0.4 | 120 | 70 | 80 | 60 | 1 |
| This invention-4 | +14.0 | 125 | 9.5 | −7.5 | 2.9 | 1.8 | 1.1 | 0.9 | 310 | 210 | 120 | 110 | 2 |
| This invention-5 | +6.5 | 110 | 4.5 | −4.2 | 2.4 | 1.2 | 0.9 | 0.8 | 210 | 110 | 80 | 70 | 1 |
| This invention-6 | +2.5 | 115 | 1.2 | −3.0 | 1.1 | 0.2 | 0.2 | 0.2 | 50 | 30 | 30 | 40 | 0 |
| This invention-7 | +1.1 | 125 | 0 | −1.1 | 3.1 | 2.1 | 1.6 | 1.2 | 410 | 240 | 210 | 220 | 2 |
| This invention-8 | +16.0 | 120 | 0.8 | −9.0 | 3.9 | 3.3 | 2.2 | 2.2 | 490 | 430 | 230 | 240 | 3 |
| Comparative example-1 | +16 | 120 | 11.0 | −8.5 | 4.6 | 3.3 | 4.2 | 4.1 | 530 | 450 | 500 | 510 | 25 |

TABLE 3

| Level | Heat-Development condition: Rate of elevating temperature (° C./second) | Part of constant temperature: Temperature (° C.) | Distribution of temperature (° C.) | Rate of lowering temperature (° C./second) | Uniform setting of conveyance tension: Method of achievement of uniform setting* | Conveying time: Shortest time (second) | Longest time (second) | Ratio of conveying time [(the longest time-the shortest time)/the shortest time] |
|---|---|---|---|---|---|---|---|---|
| This invention-9 | +3.0 | 120 | 0.5 | −2.0 | A (0.5) | 30 | 30 | 0 |
| This invention-10 | +1.5 | 115 | 0 | −1.5 | B (5) | 30 | 44 | 0.47 |
| This invention-11 | +2.0 | 110 | 2.3 | −2.5 | A (0.4) | 30 | 33 | 0.10 |
| This invention-12 | +14.0 | 125 | 9.5 | −7.5 | C (3) | 40 | 48 | 0.20 |
| This invention-13 | +6.5 | 110 | 4.5 | −4.2 | A (0.2) | 35 | 40 | 0.14 |
| This invention-14 | +2.5 | 115 | 1.2 | −3.0 | A (0.3) | 30 | 32 | 0.07 |
| This invention-15 | +1.1 | 125 | 0 | −1.1 | A (0.7) | 41 | 40 | 0.03 |
| This invention-16 | +16.0 | 120 | 0.8 | −9.0 | A (0.6) | 40 | 40 | 0 |

TABLE 3-continued

| Level | Degree of warp after heat development (mm/50 cm) | | | | Degree of undulation after heat development ($mm^2$/50 cm) | | | | Ratio of |
|---|---|---|---|---|---|---|---|---|---|
| | Front Edge | Back edge | Left edge | Right edge | Front edge | Back edge | Left edge | Right edge | dot failure (%) |
| This invention-9 | 0 | 0 | 0 | 0 | 0 | 0 | 0 | 0 | 0 |
| This invention-10 | 3.0 | 2.3 | 1.5 | 1.5 | 420 | 260 | 150 | 140 | 2 |
| This invention-11 | 1.6 | 0.2 | 0.2 | 0.3 | 100 | 50 | 60 | 40 | 1 |
| This invention-12 | 2.7 | 1.6 | 0.9 | 0.7 | 290 | 190 | 100 | 90 | 2 |
| This invention-13 | 2.1 | 1.0 | 0.7 | 0.6 | 180 | 80 | 60 | 50 | 1 |
| This invention-14 | 0.6 | 0.1 | 0.1 | 0.1 | 40 | 20 | 10 | 20 | 0 |
| This invention-15 | 1.1 | 0.9 | 0.8 | 0.5 | 80 | 60 | 60 | 30 | 0 |
| This invention-16 | 0.2 | 0.1 | 0.1 | 0.1 | 30 | 10 | 10 | 10 | 0 |

*Methods for achieving a uniform setting
Method A : A method providing a space in the bearing portion of the roll. (The value in parentheses represents the amount of the space (mm).)
Method B : A method using a crown roll. (The diameter at the central portion of the roll is increased, compared with both end portions. The value in parentheses represents the increasing rate (%).)
Method C : A method using an inverted crown roll. (The diameter at both end portions of the roll is increased, compared with the central portion. The value in parentheses represents the increasing rate (%).)

(5) Image-forming Layer (light-sensitive layer)

On the undercoating layers opposite to the back layer side, the following image-forming layer and protective layer were coated successively, and then they were dried at 65° C. for 3 minutes respectively, to obtain a heat-developable image-forming light-sensitive material.

(5-1) Preparation of silver halide grains

In 700 ml of water were dissolved 11 g of phthalated gelatin and 30 mg of potassium bromide, and 10 mg of sodium thiosulfonate. The solution was adjusted to pH 5.0 at a temperature of 35° C. To the solution, 159 ml of an aqueous solution containing 18.6 g of silver nitrate and an aqueous solution containing potassium bromide in an amount of 1 mol/l were added over 6.5 minutes by a controlled double jet method while maintaining the solution at pAg 7.7. Subsequently, to the mixture, 476 ml of an aqueous solution containing 55.4 g of silver nitrate and a halide aqueous solution containing potassium bromide in an amount of 1 mol/l were added over 30 minutes by a controlled double jet method while maintaining the solution at pAg 7.7. Thereafter, 1 g of 4-hydroxy-6-methyl-1,3,3a,7-tetrazaindene was added to the solution, and then the solution was desalted by lowering the pH thereof to cause flocculation and sedimentation. Thereafter, 0.1 g of phenoxyethanol was added to adjust the emulsion to pH 5.9 and pAg 8.2. There were obtained cubic silver bromide grains having an average grain size of 0.12 μm. a coefficient of variation of projected area diameter of 8%, and a (100) plane ratio of 88%.

After the thus obtained silver halide grains were heated at 60° C., sodium thiosulfonate was added thereto in an amount of $8.5\times10^{-4}$ mol per mol of silver, and then the resulting mixture was ripened for 120 minutes, followed by quick cooling to 40° C. Thereafter, to the mixture, there were added $1\times10^{-5}$ mol of dye S-1, $5\times10^{-5}$ mol of 2-mercapto-5-methylbenzimidazole and $5\times10^{-5}$ mol of N-methyl-N'-{3-(mercaptotetrazolyl)phenyl}urea, followed by rapid cooling to 30° C. to obtain a silver halide emulsion.

Dye S-1

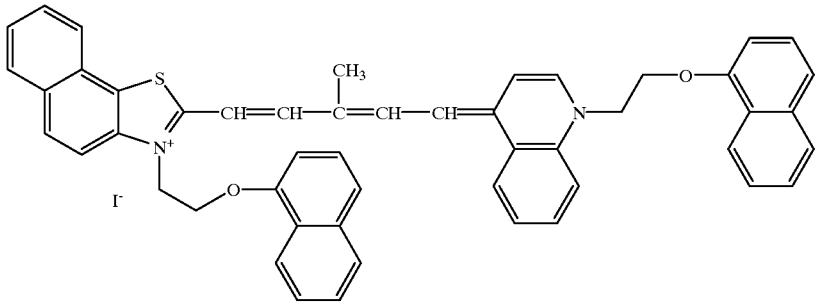

(5-2) Preparation of an organic acid silver salt dispersion 103 ml of a 1N—NaOH aqueous solution was added to 4.4 g of stearic acid, 39.4 g of behenic acid and 770 ml of a distilled water while stirring at 90° C. The solution was subjected to a reaction for 240 minutes, and then cooled to 75° C. Subsequently, 112.5 ml of an aqueous solution containing 19.2 g silver nitrate was added over 45 minutes, and then the solution was allowed to stand for 20 minutes as it was, and cooled to 30° C. Thereafter, a solid content was separated by a suction filtration, and then washed with a water until the conducting of a filtrate should reach 30 μS/cm. To the thus-obtained solid content was added 100 g of a 10 wt. % aqueous solution of hydroxy propylmethylcellulose, and further a water added thereto so that the total weight should reach 270 g. Thereafter, the mixture was placed in an automatic mortar, and roughly dispersed to obtain a coarse dispersion of an organic acid silver salt. The resulting coarse dispersion of the organic acid silver salt was dispersed by the pressure of 1000 kg/$cm^3$ at the time of collision using a nanomizer (manufactured by Nanomizer Co.), obtaining a dispersion of the organic acid silver salt. The organic acid silver salt particles of the thus-obtained dispersion of the organic acid silver salt particles were needle grains having an average minor diameter of 0.04 μm, an average major diameter of 0.8 μm, and a coefficient of variation of 30%.

(5-3) Preparation of Dispersion of Reducing Agent 850 g of water was added to a mixture of 100 g of 1,1-bis(2-hydroxy-3,5-dimethylphenyl)-3,5,5-trimethylhexane and 50 g of hydroxypropyl cellulose, and well mixed to obtain a slurry. 840 g of zirconia beads having an average diameter of 0.5 mm was placed in a vessel with the slurry. The contents were dispersed for 5 hours using a dispersing device (1/4 G sandgrinder mill, manufactured by IMEX Co., Ltd.) to obtain a dispersion of the reducing agent.

(5-4) Preparation of Dispersion of Organic Polyhalide 940 g of water was added to a mixture of 50 g of tribromomethylphenyl sulfone and 10 g of hydroxy propylmethylcellulose, and well mixed to obtain a slurry. 840 g of zirconia beads having an average diameter of 0.5 mm was placed in a vessel with the slurry. The contents were dispersed for 5 hours using a dispersing device (1/4G sandgrinder mill, manufactured by IMEX Co., Ltd.) to obtain a dispersion of the organic polyhalide.

(5-5) Preparation of Image-forming layer coating solution

To a mixture of 100 g of the above-obtained dispersion of an organic acid silver salt, 20 g of the above-obtained dispersion of a reducing agent, 15 g of the above-obtained dispersion of an organic polyhalide, were added 40 g of LACSTRA 3307B (trade name, manufactured by Dainippon Ink Chemical Industry K.K.; SBR latex; Tg 13° C.) 49 wt. %, 20 g of a 10 wt. % aqueous solution of MP-203 (trade name, manufactured by Kurare Co., Ltd.; polyvinyl alcohol), and 20 g of a silver halide emulsion, and 8 ml of a 1 wt. % methanol solution of a hydrazine compound (a compound of general formula (H)), and was further added 100 g of water. The resulting mixture was well mixed to prepare an image-forming layer coating solution.

The thus-obtained coating solution was coated so as to 1.5 g/m$^2$ of silver, and 5.7 gIm$^2$ of a solid content of the polymer latex in coating amount.

(6) Protective Layer (6-1) Preparation of Protective layer coating solution

The following coating solution was coated on the above-described light-sensitive layer so as to be 2 g/m$^2$ of a solid content of the polymer latex in coating amount.

To 500 g of a 40 wt. % of polymer latex (a copolymer of methylmethacrylate/styrene/2-ethylhexylacrylate/2-hydroxyethyl methacrylate/methacrylic acid=59/9/26/5/1; Tg 47° C.) was added 262 g of $H_2O$, and successively 14 g of benzylalcohol, 2.5 g of the following compound-2, 3.6 g of Serosol 524 (trade name, manufactured by Chukyo Yushi Co., Ltd.), 12 g of the following compound-3, 1 g of the following compound-4, 2 g of the following compound-5, and 7.5 g of the following compound-6, as a film-forming aid; and 3.4 g of polymethyl methacrylate fine particles having an average grain size of 3 μm as a matte agent were added, and $H_2O$ was further added to make the mixture upto 1,000 g. Consequently, a coating solution having viscosity 5 cp (25° C.) and pH 3.4 (25° C.) was prepared.

Compound-2

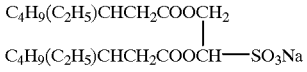

-continued

Compound-3

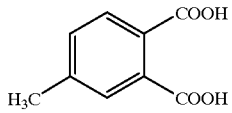

Compound-4

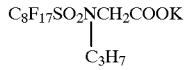

Compound-5

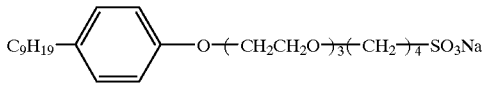

Compound-6

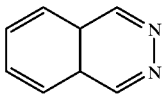

(7) Heat Development of Light-sensitive Material·Contact Exposure·Evaluation

With respect to the thus-obtained heat-developable light-sensitive material, the thermal dimensional changing ratio at 120° C. for 30 seconds and the water-absorbing dimensional changing ratio after heat development at 120° C. for 30 seconds were measured according to the above-described method.

Further, a 10% flat halftone image was exposed to the heat-developable light-sensitive material prepared according to the above-described method, and the exposed material was cut to the size of 50 cm×50 cm, and thereafter it was subjected to heat development under the conditions shown in Table 2 and 3. The heat-developable light-sensitive material was subjected to, elevating the temperature of the material from a room temperature to a predetermined constant temperature, maintaining the material at the predetermined temperature for 30 seconds, and cooling the temperature of the material from the predetermined temperature to the room temperature, at the conditions described in Table 2 and 3, in each level. After the heat development, the degree of warp and the degree of undulation of each of the four sides were measured according to the above-described method, and the results thus obtained were shown in Table 2 and 3. After that, the heat-developed material was contact exposed on a PS printing plate using a printer for the contact exposure. After the PS printing plate was developed according to a standard (established) method, an area of the portion where dot images were standing closely together (i.e. the portion where the dot images were defaced and connected together) was measured by a visual observation. The results were shown in Table 2 and 3 (the ratio of dot failure).

As is seen from the results of Comparative example-1 in Tables 1 and 2, if heat-developable light-sensitive materials—wherein no polyvinylidene chloride layer, as an undercoating layer, is applied onto both surfaces of a support, and the support is heat-treated under heat-treatment conditions other than those defined in the present invention, and both the degree of thermal dimensional change and the degree of water-absorbing dimensional changing ratio are outside of the range defined in the present invention—are subjected to heat development under heat-development conditions other than those defined in the present invention, both the degree of warp and the degree of undulation after the heat development become large, so that the problem of "printing blur" occurs, as indicated by a high ratio of dot failure. Accordingly, these comparative embodiments are not preferred.

On the other hand, as shown by the inventions-1 to -16 in Tables 1, 2, and 3, it is seen that, if heat-developable light-sensitive materials as defined in the present invention are subjected to heat development by method as defined in the present invention, both the degree of warp and the degree of undulation after heat development become low, and the ratio of dot failure becomes low, which results in no problem of the printing blur.

Each case of invention-2, invention-7, and invention-8 exhibits a somewhat larger degree of warp and a larger degree of undulation at some-side(s), in comparison with cases in which the heat-developable light-sensitive materials as defined in the present invention are subjected to heat development by the method as defined in the present invention. Herein, invention-2 represents the case that heat development is practiced using the heat-developable light-sensitive material in which polyvinylidene chloride is not incorporated in the undercoating layer. Invention-7 represents the case that heat development is practiced using the heat-developable light-sensitive material in which a heat treatment defined in the present invention is not performed, so that the thermal dimensional changing ratio is outside of the range defined in the present invention. Invention-8 represents the case that heat development is practiced using a heat-development method, in which both the temperature-elevation conditions and the temperature-cooling conditions are outside of the range defined in the present invention. However, if the above-described cases are compared to Comparative example-1, there is no problem about the dot failure ratio, and the problem of the printing blur does not occur.

Furthermore, as shown by inventions-9 to -16, it is seen that, when heat development is carried out in a uniform setting by making the distribution of the conveyance tension in the range defined in the present. invention, both the degree of warp and the degree of undulation after heat development become lower, the ratio of dot failure becomes low, and therefore these embodiments are preferred.

Having described our invention as related to the present embodiments, it is our intention that the invention not be limited by any of the details of the description, unless otherwise specified, but rather be construed broadly within its spirit and scope as set out in the accompanying claims.

What is claimed is:

1. A dry silver heat-developable photographic light-sensitive material, wherein the degree of warp at the edge portion of each of four sides of the light-sensitive material after heat development is in the range of from 0 mm/50 cm to 4 mm/50 cm.

2. The dry silver heat-developable photographic light-sensitive material as claimed in claim 1, wherein the degree of undulation at the edge portion of each of four sides of the dry silver heat-developable light-sensitive material after heat development is in the range of from 0 $mm^2$/50 cm to 500 /$m^2$/50 cm.

3. The dry silver heat-developable photographic light-sensitive material as claimed in claim 1, wherein a thermal dimensional change at 120° C. for 30 seconds is in the range of from −0.05 to +0.05% in both the longitudinal direction and the transverse direction.

4. The dry silver heat-developable photographic light-sensitive material as claimed in claim 1, wherein a water-absorbing dimensional changing rate after heat development at 120° C. for 30 seconds is in the range of from 0%/2 hours to 0.025%/2 hours in both the longitudinal direction and the transverse direction.

5. The dry silver heat-developable photographic light-sensitive material as claimed in claim 1, comprising, as a support, a polyethylene terephthalate film that has been subjected to heat treatment at a temperature between 140° C. and 200° C., under a tension of 0 kg/m to 5 kg/m, for a time period in the range of from 20 seconds to 5 minutes.

6. The dry silver heat-developable photographic light-sensitive material as claimed in claim 1, comprising a support whose both surfaces each are coated with a layer of a polyvinylidene chloride resin, in a thickness of 0.5 $\mu$m to 10 $\mu$m.

7. The dry silver heat-developable photographic light-sensitive material as claimed in claim 1, wherein a thermal dimensional change at 120° C. for 30 seconds of the dry silver heat-developable photographic light-sensitive material is in the range of from −0.05 to +0.05% in both the longitudinal direction and the transverse direction, and wherein the dry silver heat-developable photographic light-sensitive material is subjected to heat development by a method, in which heat-development step is carried out under a distribution of a conveyance tension in the range of 0 to 0.5.

8. The dry silver heat-developable photographic light-sensitive material as claimed in claim 1, wherein a thermal dimensional change at 120° C. for 30 seconds of the heat-developable photographic light-sensitive material is in the range of from −0.05 to +0.05% in both the longitudinal direction and the transverse direction, and wherein the dry silver heat-developable photographic light-sensitive material is subjected to heat development, after raising a temperature at a rate of 1° C./second to 15° C./second.

9. The dry silver heat-developable photographic light-sensitive material as claimed in claim 1, wherein a thermal dimensional change at 120° C. for 30 seconds of the dry silver heat-developable photographic light-sensitive material is in the range of from −0.05 to +0.05% in both the longitudinal direction and the transverse direction, and wherein the dry silver heat-developable photographic light-sensitive material is subjected to heat development, and the heat-developed light-sensitive material is cooled at a cooling rate of 1° C./second to 15° C./second.

10. A method for subjecting a dry silver heat-developable photographic light-sensitive material, to heat-development under a distribution of a conveyance tension in the range of 0 to 0.5, wherein a thermal dimensional change at 120° C. for 30 seconds of the dry silver heat-developable photographic light-sensitive material is in the range of from −0.05 to +0.05% in both the longitudinal direction and the transverse direction, and wherein after the heat development the degree of warp at the edge portion of each of four sides of the dry silver heat-developed light-sensitive material is in the range of from 0 mm/50cm to 4 mm/50 cm.

11. The method for subjecting a dry silver heat-developable photographic light-sensitive material as claimed in claim 10, wherein a heat-development temperature is in the range of 80° C. to 140° C., a temperature distribution along the transverse direction is in the range of from 0° C. to 10° C., and a heat-development time is in the range of from 10 seconds to 120 seconds.

12. A method of heat development which comprises heating a dry silver heat-developable photographic light-sensitive material for development, after raising a temperature at a rate of 1° C./second to 15° C./second, wherein a thermal dimensional change at 120° C. for 30 seconds of the heat-developable photographic light-sensitive material is in the range of from −0.05 to +0.05% in both the longitudinal direction and the transverse direction, and wherein after the heat development the degree of warp at the edge portion of each of four sides of the heat-developed light-sensitive material is in the range of from 0 mm/50 cm to 4 wm/50 cm.

13. The method of heat development as claimed in claim 12, wherein a heat-development temperature is in the range of 80° C. to 140° C., a temperature distribution along the transverse direction is in the range of from 0° C. to 10° C., and a heat-development time is in the range of from 10 seconds to 120 seconds.

14. A method of heat development which comprises heating a dry silver heat-developable photographic light-sensitive material for development, and cooling the heat-developed light-sensitive material at a cooling rate of −8° C./second to −1° C./second, wherein a thermal dimensional change at 120° C. for 30 seconds of the heat-developable photographic light-sensitive material is in the range of from −0.05 to +0.05% in both the longitudinal direction and the transverse direction, and wherein after the heat-development the degree of warp at the edge portion of each of four sides of the heat-developed light-sensitive material is in the range of from 0 mm/50 cm to 4 mm/50 cm.

15. The method of heat development as claimed in claim 14, wherein a heat-development temperature is in the range of 80° C. to 140° C., a temperature distribution along the transverse direction is in the range of from 0° C. to 10° C., and a heat-development time is in the range of from 10 seconds to 120 seconds.

* * * * *